United States Patent [19]

Thompson

[11] Patent Number: 4,834,198

[45] Date of Patent: May 30, 1989

[54] POSITIVE LATCH WIRE LINE CORE BARREL APPARATUS

[75] Inventor: Terrence L. Thompson, Minneapolis, Minn.

[73] Assignee: Longyear Company, Salt Lake City, Utah

[21] Appl. No.: 185,703

[22] Filed: Apr. 25, 1988

[51] Int. Cl.[4] ..... E21B 10/64

[52] U.S. Cl. ..... 175/244; 175/250

[58] Field of Search ..... 175/244, 246, 247, 248, 175/250, 253

[56] References Cited

U.S. PATENT DOCUMENTS

| | | | |
|---|---|---|---|
| 1,427,268 | 8/1922 | Dodd . | |
| 3,004,614 | 10/1961 | Jansen et al. . | |
| 3,120,282 | 2/1964 | Pickard . | |
| 3,120,283 | 2/1964 | Braun . | |
| 3,266,835 | 8/1966 | Hall et al. . | |
| 3,292,717 | 12/1966 | Hall et al. . | |
| 3,333,647 | 8/1967 | Karich et al. . | |
| 3,340,939 | 9/1967 | Lindelof . | |
| 3,485,310 | 12/1969 | Milosevich | 175/246 |
| 3,667,558 | 6/1972 | Lambot | 175/246 |
| 3,701,389 | 10/1972 | Egnelov et al. . | |
| 3,874,466 | 4/1975 | Fulford | 175/236 |
| 3,955,633 | 5/1976 | Bowles | 175/258 |
| 4,603,749 | 8/1986 | Davis et al. | 175/250 |
| 4,664,205 | 5/1987 | Knighton et al. | 175/253 X |

FOREIGN PATENT DOCUMENTS 2014485 4/1970 France .

OTHER PUBLICATIONS

Huddy Inc.—Price List—Shurlock System.

Longyear Company, "Underground Wireline Core Barrels", Longyear Company Portion of drawing of AQ-U Wireline.

*Primary Examiner*—William P. Neuder

*Attorney, Agent, or Firm*—Clayton R. Johnson

[57] ABSTRACT

Core barrel apparatus that includes an inner tube assembly that may fall under gravity or be fluidly propelled through a drill string to the bit end thereof for being retained at the bit end by latches and being retractable by an overshot assembly. The inner tube assembly includes an annular seal portion for forming a fluid seal with the drill string and a fluid by-pass channel with valving mechanism extending therein to permit outward flow but block inward flow while the inner tube assembly is being fluidly propelled inwardly. The inner tube assembly also includes control mechanism to prevent the valving mechanism being moved to permit significant inward flow through the channel only after fluid pressure has been applied to the inner tube assembly at the bit end of the drill string, the latches have moved to their latch seat engaging position and then inward fluid pressure has been significantly decreased.

34 Claims, 6 Drawing Sheets

26b
30
49
51
50
60
47
30
51
51a
46
48
26a
37
28
33
27
28
16b
38
39
55
16a
32
29
43
30
42
55a
44a
33a 12
72
158
H
H
143

172
201
188
195
197
200
199

172
200
201
197
195
198
199
188
196

175
175a
177
178
169b
182
169a
168
174
167
142a
172
183
190
183b
189

POSITIVE LATCH WIRE LINE CORE BARREL APPARATUS

BACKGROUND OF THE INVENTION

A core barrel inner tube assembly that is propellable under fluid pressure to the bit end of a drill string and provide an open bypass channel for inward flow therethrough only after the latch has moved to its latch seated position.

In U.S. Pat. No. 3,120,283 to Braun there is disclosed a core barrel inner tube assembly having an overshot coupling portion retained in a position by the latches in their retracted position to prevent fluid bypass until the latches move to their seated position and thence under gravity or inward fluid pressure move to permit fluid bypass and prevent the latches moving to their retracted position until the coupling portion is retracted; and a fluidly propellable overshot assembly. Also it is old to provide a core barrel inner tube assembly that is similar to that of the second embodiment of U.S. Pat. No. 3,333,647 to Karich except that the spearpoint plug has an annular fluid seal member with a bypass channel that includes an outer port opening outwardly of the seal member and an inner port that is blocked by the latch release tube when the plug is in its inner position relative to the tube, and resilient means to urge the release tube inwardly relative to the latch body to the release position. The plug is mechanically forced to its bypass open position when the release tube moves inwardly.

U.S. Pat. No. 3,266,835 to Hall discloses a core barrel inner tube assembly fluidly propellable in any direction and includes a valve assembly connected to a spearhead and resiliently urged to a position to block fluid flow. When the inner tube assembly moves to its inner position, water pressure forces the spearhead assembly to move to open a bypass channel and allow the latches to move to a latch seated position. If the latches do not seat properly a valve is not opened and bypass is blocked. French Patent No. 2,014,485 discloses a first embodiment of a latch that has an axial outer hook portion for couplingly engaging an overshot assembly and an inner hook portion extending transversely in the opposite direction from that of the hook portion for coupling engaging a latch seat while the second embodiment has an outer hook portion for couplingly engaging an overshot assembly and an outer portion for engaging a latch seat, both of which are outwardly of the latch pivot. U.S. Pat. No. 3,701,389 to Egnelov et al also discloses some of the same structure as disclosed in the French patent. U.S. Pat. No. 1,427,268 to Dodd discloses outer latches to block outer movement of the core barrel inner tube assembly and inner latches to block inward movement when in the core collecting position.

In order to provide a core inner tube assembly that provides advantages over prior art assembles, this invention has been made.

SUMMARY OF THE INVENTION

A core barrel inner tube assembly that includes a latch body portion pivotally mounting a latch for movement between a retracted position and a latch seated position, an axially elongated portion extending axially relative to the latch body portion for defining a fluid bypass channel, valving mechanism extending within the channel that is movable between a first position substantially blocking inward flow through the channel and a second position providing a fully open fluid channel, valve control mechanism that is movable relative to the latch body and elongated portion for moving the valving mechanism from the valving mechanism second position after the latch has moved from its retracted position to its latch seated position with the assembly at the bit end of a drill string and inward fluid pressure has been significantly decreased from that previously applied. In one embodiment the valving mechanism is at least in part retained in its first position by the valve control moving mechanism which in turn is prevented from moving the valving mechanism by abutting against the latch in the latch retracted position. In another embodiment the valving mechanism and the elongated portion are of a construction that the valving mechanism is moved inwardly from a fluid channel open position to the valving mechanism blocking position by inward fluid flow when the bore hole extends upwardly in an inward direction. Advantageously the last mentioned embodiment has a latch with an overshot hooking portion and a foot on the opposite axial side of a latch pivot to extend transversely outwardly in the same direction with the foot being abuttable against the valve control mechanism to prevent the valve control mechanism moving the valving mechanism to its second position until the latch moves from its retracted position to the latch seated position.

One of the objects of this invention is to provide a new and novel core barrel inner tube assembly that requires its latch moving to its latch seated position and a substantial decrease of inward fluid pressure applied to the assembly before a fluid bypass channel fully opens for inward bypass fluid flow. In furtherance of the above object, it is another object of this invention to provide an assembly that is fluidly propellable inwardly regardless of the direction of extension of the bore hole. Another object of this invention is to provide in a core barrel assembly new and novel means for blocking inward fluid bypass until the assembly latch means moves to its latch seated position and retains the latch means in the latch means seated position until the assembly is retracted by an overshot device.

A different object of this invention is to provide new and novel positive latch means in a core barrel inner tube apparatus that will provide and maintain a high pressure signal at the sur face until after the apparatus latch has moved to its seated position and the pump-in pressure is significantly decreased. Still a different object of this invention is to provide a new and novel latch for a core barrel inner tube assembly.

For purposes of facilitating the description of the invention the term "inner" refers to that portion of the drill string, or of the assembly, or an element of the assembly being described which in its position "for use" in, or on, the drill string is located closer to the drill bit on the drill string or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element being described which in its position of "for use" in or on the drill string is located axially more remote from the bit on the drill string than any other portion of the apparatus being described, except where the term clearly refers to a transverse circumferential, direction or diameter of the apparatus being described.

BRIEF DESCRIPTION OF THE DRAWINGS

FIGS. 1-4 when arranged with their axial center lines aligned and lines A—A of FIGS. 1, 2 aligned; lines B—B of FIGS. 2, 3 aligned; and lines C—C of FIGS. 3, 4 aligned, form a composite longitudinal view through the first embodiment of the core barrel inner tube assembly of this invention with portions of the drill string and longitudinal spaced portions of FIG. 4 being broken away, said view showing the inner tube assembly in its latched core drilling position and being generally taken along the line and in the direction of the arrows 1—1 of FIG. 10;

FIGS. 5 and 6 when arranged with their axial center lines aligned and lines D—D aligned form a composite longitudinal view through an overshot assembly and the outer end portion of the core barrel inner tube assembly of FIG. 1 other than the inner tube assembly is shown in its retrieval position just after the latches have been retracted;

FIG. 10 is an enlarged fragmentary cross sectional view generally taken along the line and in the direction of the arrows 10—10 of FIG. 1;

FIG. 11 is an enlarged outer end view of the latch body that is generally taken along the line and in the direction of the arrows 11—11 of FIG. 1;

FIG. 12 is a longitudinal view, part in cross section, that is generally taken along the line and in the direction of the arrows 12'12 of FIG. 1;

FIGS. 13-16 when arranged with their center lines aligned and lines F—F of FIGS. 13, 14 aligned., lines G—G of FIGS. 14, 15 aligned; and lines H—H of FIGS. 15, 16 aligned, form a composite longitudinal sectional view through the outer portion of the second embodiment of the core barrel inner tube assembly of this invention with portions of the drill string broken away, said view showing said assembly at the bit end portion of the drill string with the valving mechanism in its fluid channel blocking position, the inner latches in their latch seated position, the outer latches just prior to their moving to their latcth seated position and the latch release tube adjacent to its latch retracted position; the cam slot being shown as taken along the line and in the direction of the arrows 13—13 of FIG. 13 and the adjacent release tube slot being shown as if aligned with the entire cam slot;

FIG. 17 shows a portion of the structure of FIGS. 14, 15 with the outer latches in their latch seated position;

FIG. 18 is a fragmentary side view of the second embodiment of the core barrel inner tube assembly rolled out flat with the guide pin in the 13 position;

FIG. 19 is a view of the structure of FIG. 18 other than the guide pin is in the inner tube assembly drilling position;

Figures 2, 3, 4:
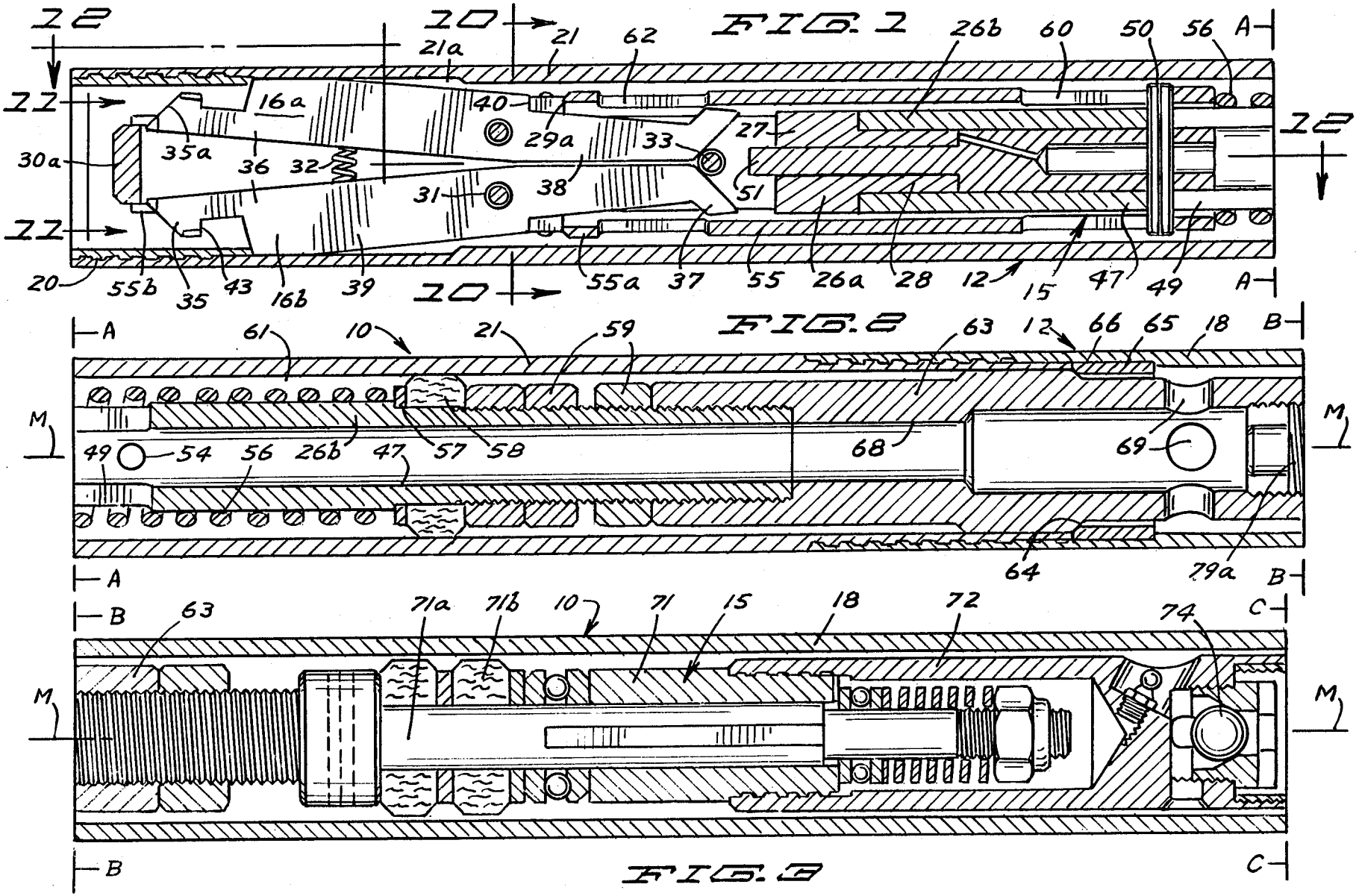

Refering now in particular to FIGS. 1-4, there is illustrated a hollow drill string 10 which is made up of section of pipe (drill rods) coupled together and having an annular drill bit 11 mounted on the inner end thereof, pump apparatus being indicated by block 284 for pumping fluid under pressure through line 285 into the outer end of the drill string in a conventional manner.

The inner end portion of the drill string is commonly referred to as a corr barrel outer tube assembly, generally designated 12; the core barrel outer tube assembly being provided for receiving and retaining the core barrel inner tube assembly, generally 15. Details of the construction of the core barrel outer tube assembly of the general nature used in this invention may be such as that disclosed in U.S. Pat. Nos. 3,120,282 and 3,120,283. The core barrel outer tube assembly 12 is composed of a core barrel outer tube 18, a reaming shell 19 threadedly connected to the inner end of the tube 18 and an annular drill bit 11 for drilling into the earth formation from which the core sample is taken, said bit being threadedly connected to the inner end of the reaming shell. The outer end of the assembly 12 includes a locking coupling 20 which connects the assembly 12 to the adjacent pipe section of the drill string. At the opposite end of the coupling 20 from the above mentioned pipe section, an adaptor coupling 21 is connected. The inner end of the locking coupling in conjunction with the annular recess **21*a* of the coupling 21 form a seat inside of the surface of the adaptor couping against which the outer latches (detent members) 16*a*, 16*b* of the core barrel inner tube assembly are seated for removably retaining the assembly 15 adjacent to the core bit. The inner end portion of the locking coupling may have a projection flange to bear against the face of a latch to cause the latches and other portions of the core barrel inner tube assembly to rotate with the drill string when the latches are in a latch seated position such as indicated in FIG. 1**.

Threadly connected to the inner end of the adaptor coupling is the core barrel outer tube, it being understood that a hanger coupling (not shown) could be interposed between the adaptor coupling and the outer tube and in which case the outer tube would be of a shorter length. The adaptor coupling 21 where it is threadedly to the core barrel outer tube is provided with an annular recess 66 for mounting a landing ring 65.

The core barrel inner tube assembly 15 includes a latch body made up of an outer latch body portion **26*a* that at its inner end is threadedly connected to the latch body inner portion 26*b*, and has the latches 16*a*, 16*b* mounted to portion 26*a* in the latch body slot 27 by pivot pins 31. The slot 27 extend radially through the latch body and is defined by the inner parts 28 of the outer portion 26*a*, parallel, axially elongated, generally plate shaped, axial intermediate parts 29, axial outer parts 30 extending outwardly of parts 29 and a head 30*a* joined to the outer ends of parts 30. The axial intermediate parts 39 of the latches 16*a*, 16*b* are pivotally mounted in opposite faced relationship by pins to the latch body parts 29 and have opposite ends of a coil spring 32 seated in radial hole outwardly of the pins to resiliently urge the latches outer end portions 35, 36 to their extended latch seated position. The pivotal movement of the latches in their latch seated position is limited by the latch feet abutting against a limit pin 33 which is mounted by latch body portion 26***a*. The latches have inner portions 37, 38 that include the latch feet 37 which are inclined axially inwardly in a radially outwardly direction and elongated inner portion outer parts 38 that connect the feet to the latch intermediate portions 39.

The latch axially elongated outer parts 38 are integrally joined to feet 37 which extend further radially outwardly relative the central axis M-M of the inner tube assembly than the axially adjacent parts of parts 38. The parts 38 are integrally joined to axially elongated latch intermediate portion to form radial outward, downwardly facing shoulders 40. Integrally joined to the outer ends of portions 39 are radially narrow neck parts 36 of latch outer portions 35, 36 that are of radial dimensions substantially smaller radial dimensions than portions 39 whereby portions 39 have radial and axial outer corner portions seatable in the recess 21*a* in abutting relationship to the inner edge of the lock coupling. Latch outer end portions 35, 36 include overshot engagable end (hook) parts 35 that are integrally joined to the outer ends of parts 36 and are of grater radial dimensions than parts 36 to form radial outer, inwardly facing shoulders 43. Parts 35 have axial beveled edges 35*a* that radially diverge in an axial inward direction. Parts 35 are located in the outer end portion of slots 27 and extend further radially outwardly of the central axis M—M than parts 36. Hardsurface parts 29*b* are provided on parts 29.

As may be seen from FIGS. 1 and 12, the outer portion of head 30*a* has an outer frustoconcial part which has an inner major base that is of at least substantially the same dimension as the minimum spacing of edges 35*a* when the latches are in an extended positon to facilitate the overshot assembly, generally designated 44 (FIGS. 1, 5 and 6) couplingly engaging the latches when the overshot assembly is moved inwardly relative to the latches and the latches are in their latch seated position.

The latch body includes an axially elongated central bore 46, 47 having an axial outer reduced diameter bore portion 46 that at one end opens to the inner end of slot 27 and at the opposite end opens to the larger diameter bore portion 47. Bore portion 47 extends axially through the latch body inner portion 26*b* and has an outer end into which the reduced diameter part of the latch body portion 26*a* is extended and permanently fixed in place.

The outer end portion of the latch body inner end portion has diametric axially elongated slots 49 into which the transverse pin 50 of valve control mechanism 50, 55 is slidably extended. The pin is fixed to the valving mechanism (piston) 51 which has a reduced diameter portion 51*a* that is of a greater axial length than bore portion 46 and is slidably extended within bore portion 46 to form a close fit therewith. The valving mechanism also includes a main body 51*b* forming a close slidable fit with the wall defining bore portion 47 and advantageously of an axial length about the same as that of portion 51*a*. A fluid passage 52, 53 is provided to extend the length of the main body and has a passage portion 53 that at its inner end opens to the bore 47 inwardly of the piston 51. The reduced diameter portion 52 of the passage opens through the beveled surface formed at the juncture of piston portions 51*a*, 51*b* and at the opposite end to passage portion 53 which is of a much larger diameter than portion 52 and is transversely centered relative to piston portion 51*b*. passage 52, 53 permits flow of fluid between the bore portion 47 inwardly of the piston and the outer end of the bore portion 47.

Figures 4, 5, 6, 20, 22:
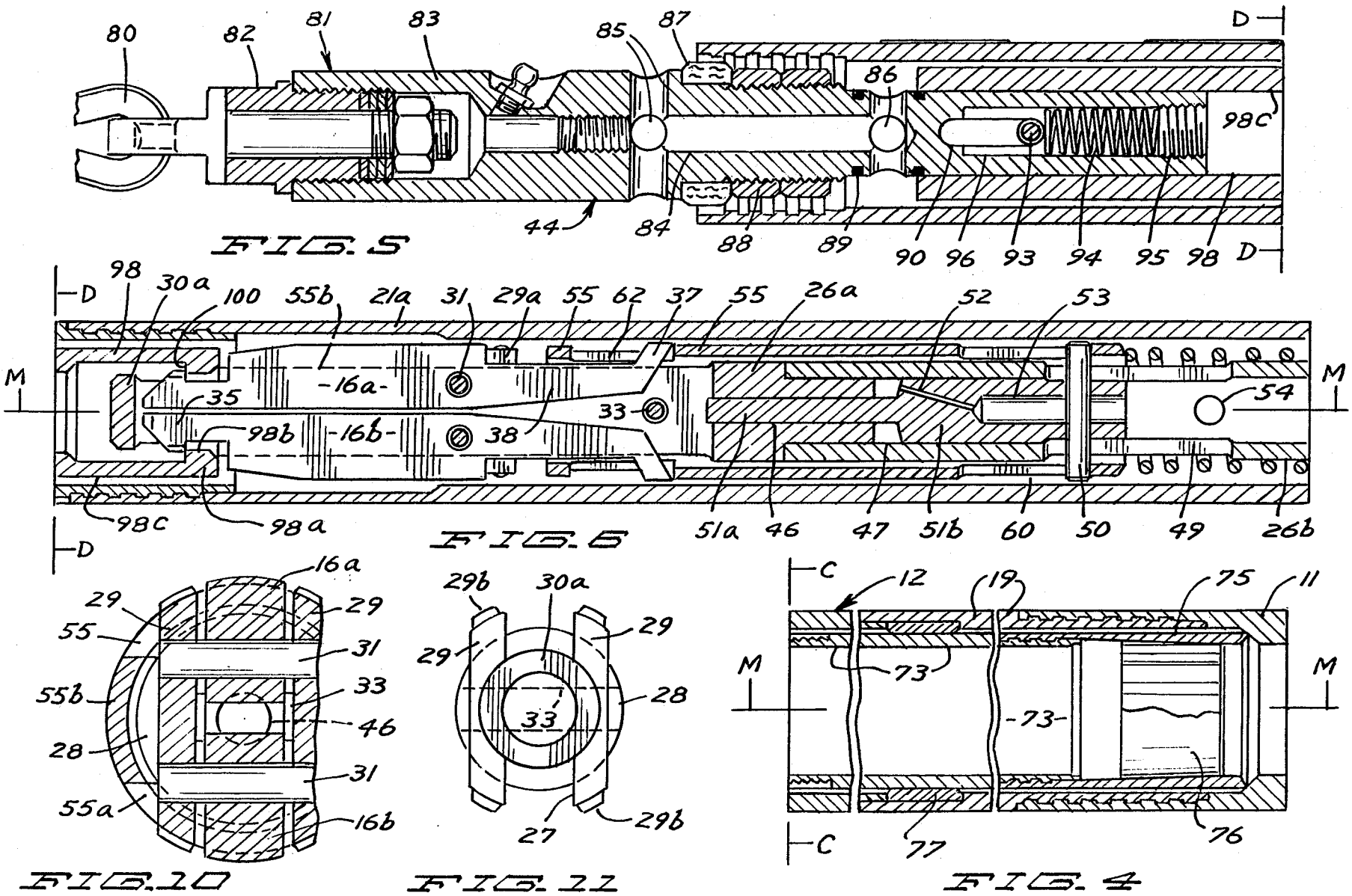

The latch body inner portion 26*b* also has diametrically opposed ports 54 angularly spaced from the inner ends of the slots 49 (which also form elongated outer ports) that place the bore 47 in fluid communication with the annular clearance space 61 between the latch body and the drill string when the inner end of the valving member 51 is at least partially outwardly of the innermost parts of ports 49, 54 (see FIG. 6).

The valve control mechanism also includes an axially elongated tubular member (latch case) 55 that has a tubular main body 55*a* surrounding an axial portion of the latch body and is axially moveable relative thereto and therewith. The axial movement is limted by the pin 50 extending into diametrically opposite, axially elongated slots 60 in the tubular member main body (see FIGS. 1 and 2). The tubular member is constantly resiliently urge outwardly by a coil spring 56 that has one end thereagainst and an opposite end bearing bearing against a metal washer 57 that abuts against a downwardly facing annular shoulder of the latch body inner portion 26*b*. A resilient washer or annular fluid seal member 58 is interposed on the latch body between the washer 57 and lock nuts 59 that are threaded on the latch body, the seal member being of a diameter to form a close fit with the inner peripheral wall of the adaptor coupling and substantially form a fluid seal with the drill string outwardly of the latch seat.

The tubular member main body 55*a* also has diametrically opposed, axially elongated slots 62 adjacent to the outer end of the main body. The latch feet 37 are extended into the slots during the time the inner tube assembly is being retracted, while when the latches are in their latch seated extended position and the inner tube assembly is in its drilling position the feet are located within the tube and inwardly of the slots 62 to abut against the main body 55*a* to prevent the latches being retracted out of the latch recess until after the tubular member 55 is moved inwardly relative to the latch body. Further the tubular member 55 has an axially elongated slot 48 opening for a grease fitting (not shown) on the latch body for piston portion 51*b*.

The tubular member also includes a pair of diametric opposed legs 55*b* extending outwardly of the main body 55*a* that are of the same inner and outer diameters as the main body to form outwardly opening slots to have the latches extend transversely outwardly therethrough. The legs are of axial lengths that when the inner tube assembly is in its core drilling position with the bypass channel open, their axial outer treminal edges are located a short distance outwardly of the latches in their latch seated position.

A landing body 63 at its outer end is threadly mounted by the inner end of the latch body (see FIG. 2). The landing body has an axial intermediate maximum diameter portion providing an annular axially inwardly facing shoulder 64 which is seatable on a landing ring 65 that is mounted in the annular recess 66 of the drill string to limit inward movement of the inner tube assembly. Recess 66 is defined by the adaptor coupling 21 and core barrel outer lube 18.

The landing body also has a bore 68 extending axially therethrough to open to bore 47. Further the landing body has a plurality of ports 69 that open to bore 68 and that, when the landing shoulder is seated on the landing ring, open to the annular clearance space radially between the outer tube 18 and the landing body and axially inwardly of the landing ring. The inner end of bore 68 is closed by having the spindle 71a of the spindle assembly 71 threadedly mounted by the landing body and extended into bore 68. The slots 49 and ports 54 open to the clearance space axially outwardly of the landing body maximum diameter portion to in conjunction with bores 46, 68 and ports 67 form a fluid bypass channel.

Referring to FIGS. 3 and 4, the inner tube assembly includes an inner tube cap 72, an inner tube 73, a valve assembly 74, a replaceable core lifter case 75 and a core lifter 76 such as disclosed in my copending application Ser. No. 125,016, filed Nov. 24, 1987. Since these members are of a similar construction and function in the same manner as disclosed in said copending application, they will not be described herein. A stabilizer ring 77 is mounted in an annular recess provided by the core barrel outer tube 18 and reaming member 19 to function as described in U.S. Pat. No. 3,340,939.

Referring to FIGS. 5 and 6, the overshot assembly, generally 81, that may be used to retract the first embodiment of the inner tube assemble, includes a swivel subassembly 82 to which the wire line cable 80 is attached. The subassembly is threadedly mounted by the outer end of the overshot body 83, the intermediate portion of which has an axially elongated bore 84 that at one end opens through ports 85 exterior of the body 83 and at the inner end opens through inner ports 86 exterior of the reduced diameter, inner end portion of the body. A resilient shut off valve 87 is retained in abutting relationship to an axially inwardly facing shoulder of body 83 by adjusting nuts 88 threaded on the body reduced diameter portion. The shut off valve forms a close fit with the inner peripheral wall of the drill string with ports 85, 86 and bore 84 forming a bypass channel that opens on axially opposite sides of the shut off valve and nuts 88. O-rings 89 are mounted in annular grooves on axially opposite sides of ports 86.

The overshot body is provided with axially elongated slots 90 inwardly of ports 86 into which a transverse pin 93 is slidably extended. A latch coupling tube 98 is slidably extended over the reduced diameter inner end portion of the overshot body, the tube mounting the pin 93 in a fixed position relative thereto. A compression spring 94 has one end abutting against pin 93 and an opposite end abutting against a set screw 95 threaded into the inner end of bore 96 to, through pin 93, resiliently urge the coupling tube outwardly relative to the overshot body. The axial movement of the coupling tube relative to the overshot body in one direction is limited to a position ports 86 are unblocked by the pin 83 abutting against the inner ends of slots 90, and in the opposite direction to a position ports 86 are blocked by the coupling tube with the pin abutting against the opposite ends of the slots. The coupling tube has an internal flange 98*a* providing an outwardly facing shoulder 100 and a bore 98*b* that opens to bore 98*c* and of a diameter that is sufficiently great to have the latch body part 30*a* pass therethrough.

Figure 7:
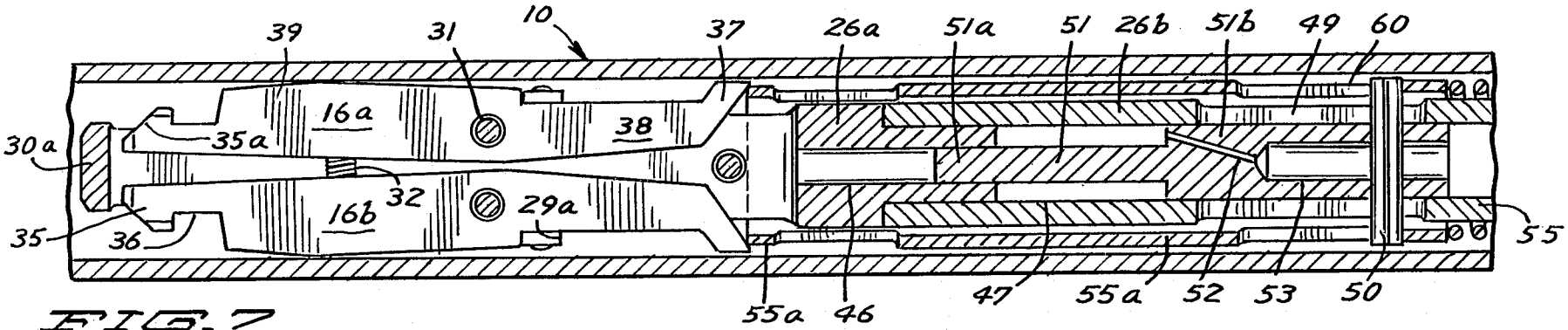
FIG. 7 is a view corresponding to FIG. 1 other than it shows the valving mechanism and latches in their pump-in position.
Figure 8:
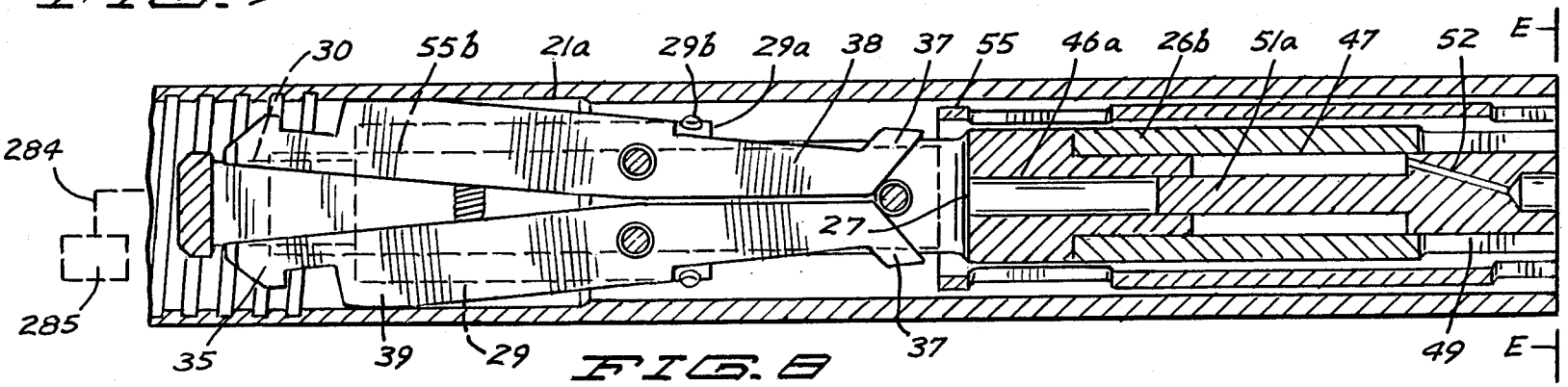
FIGS. 8 and 9 when arranged with their axial center lines aligned and lines E—E aligned form a composite longitudinal view through the axial outer end portion of the core barrel inner tube assembly is shown in its landing position with its latches in their fully extended latching position and the valving mechanism in its innermost position relative to the latch body.
Figure 9:
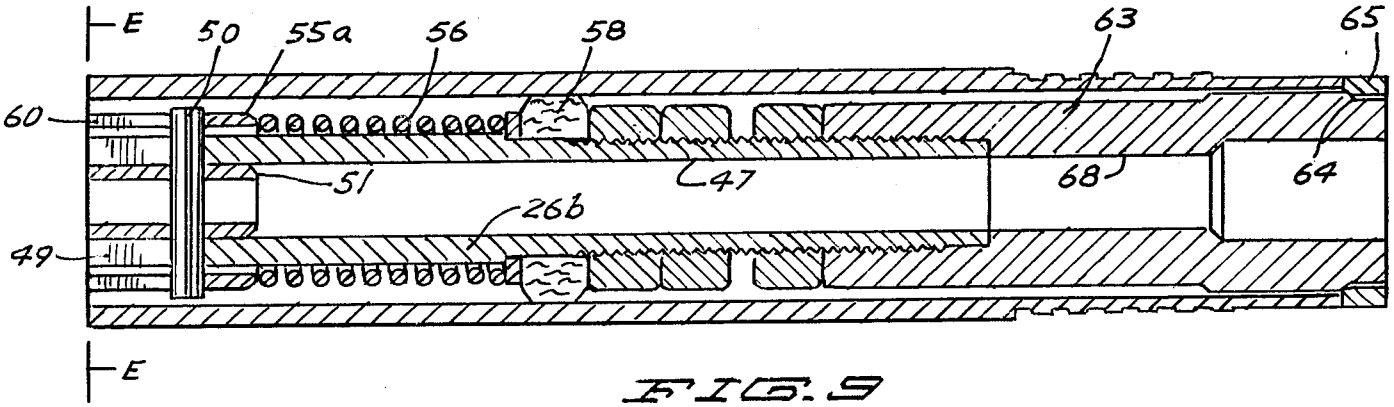
Figures 26, 27, 28, 29:
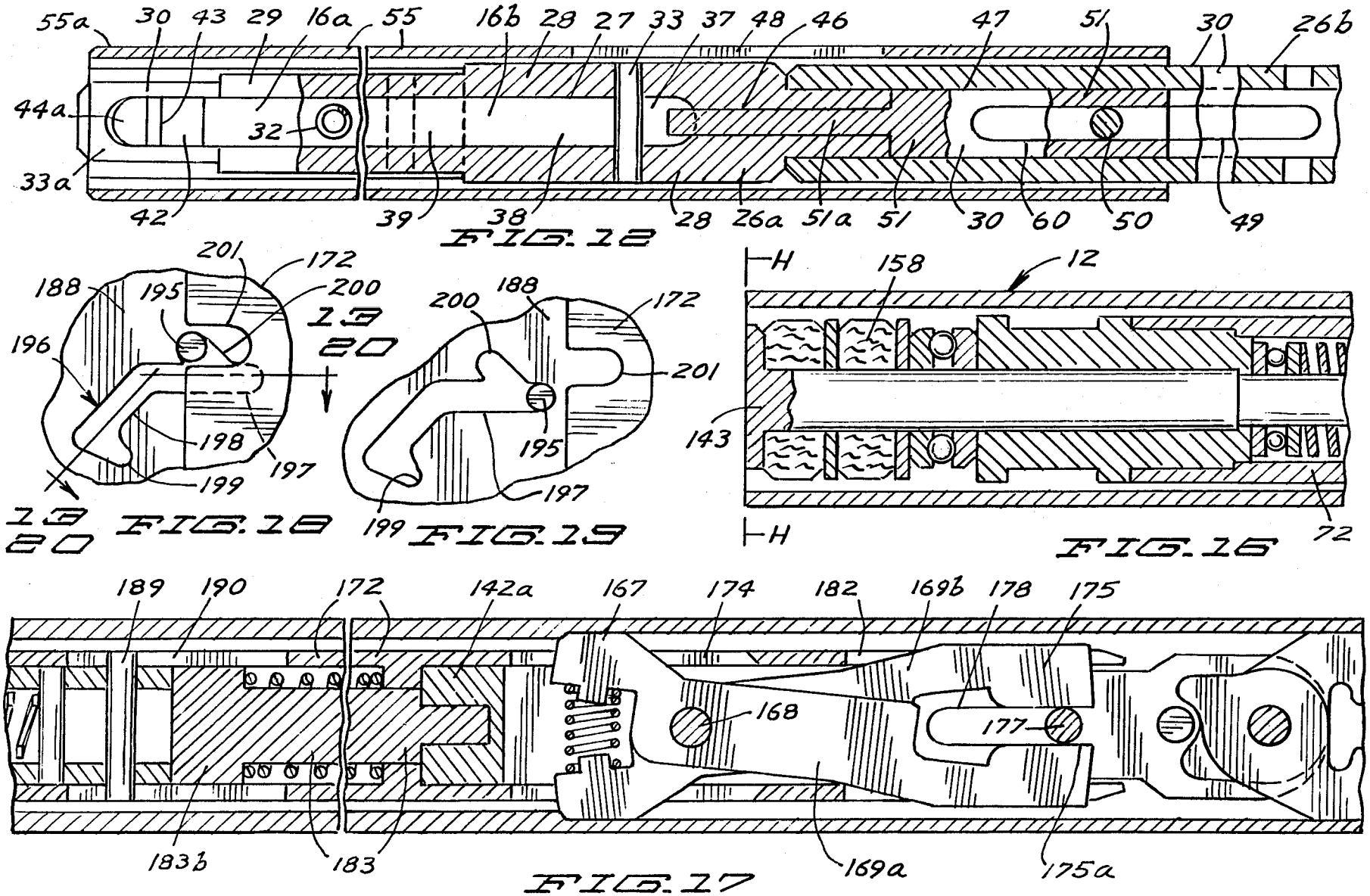
Figure 23:
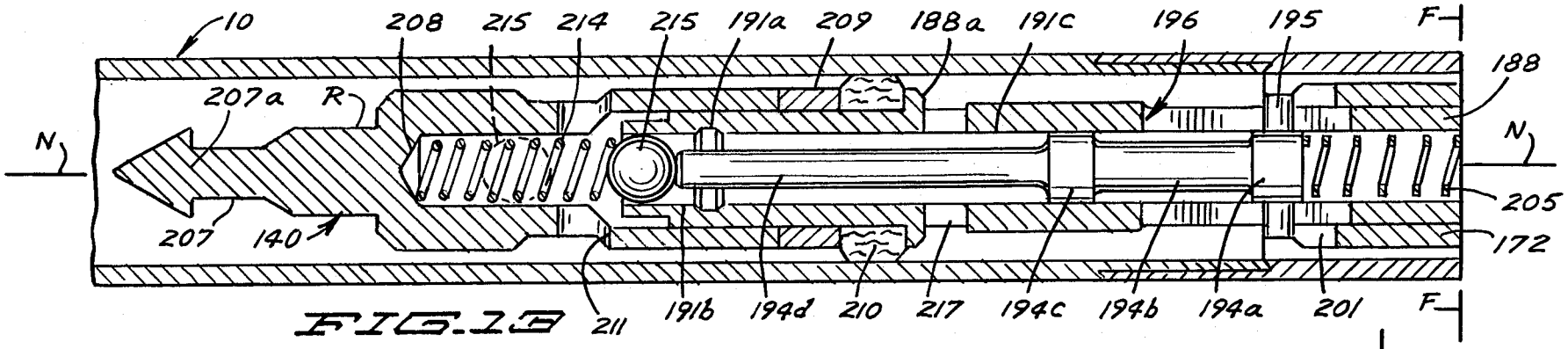
Figure 24:
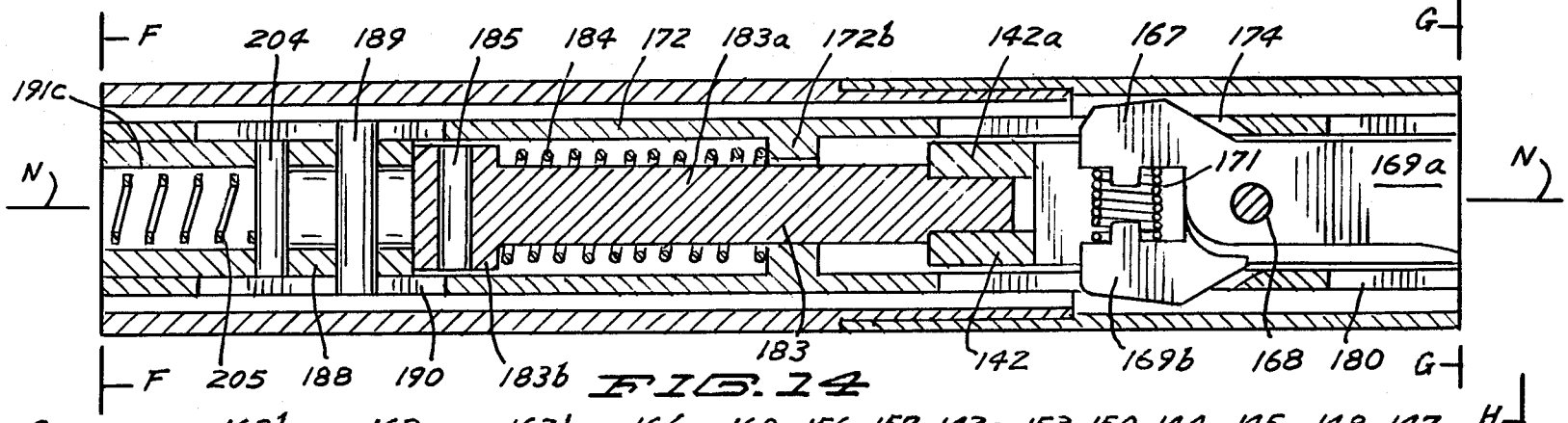
Figure 25:
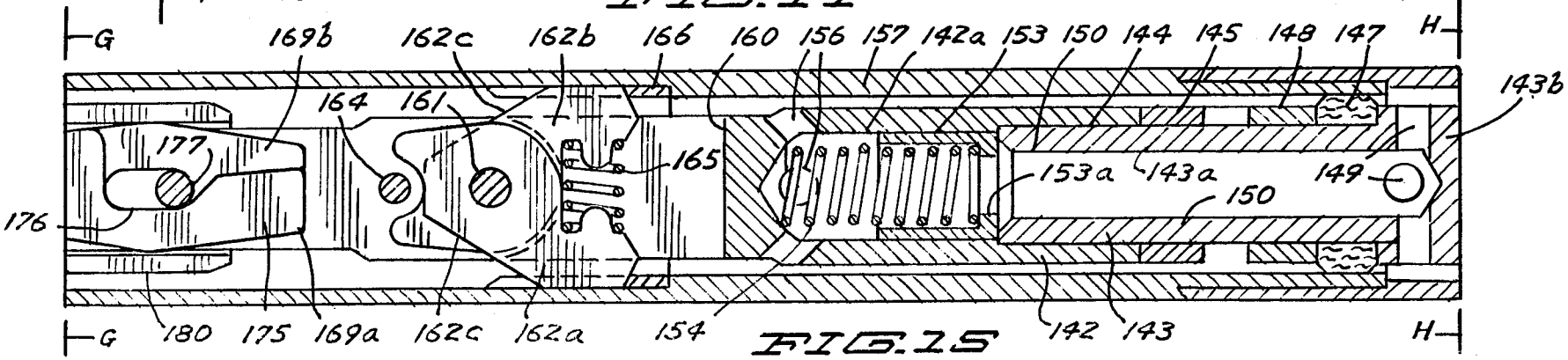
Figure 20:
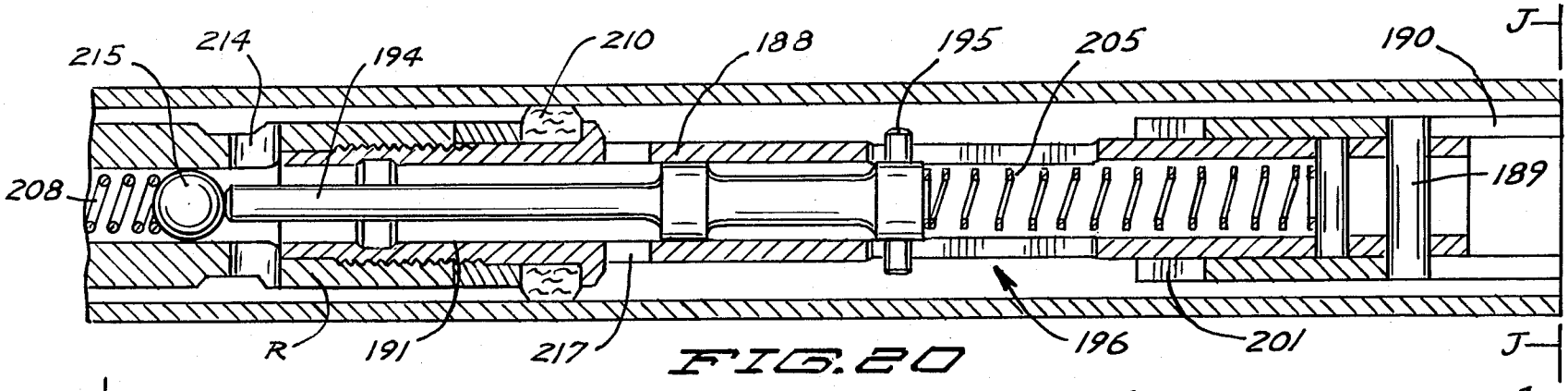
FIGS. 20 and 21 when arranged with their center lines aligned and lines J—J of FIGS. 20, 21 aligned, form a composite longitudinal view of the second embodiment in the assembly retrieval position with various axial intermediate portions broken away and the cam slot being shown as taken along the line and in the direction of the arrows 20—20 of FIG. 13.
Figure 21:
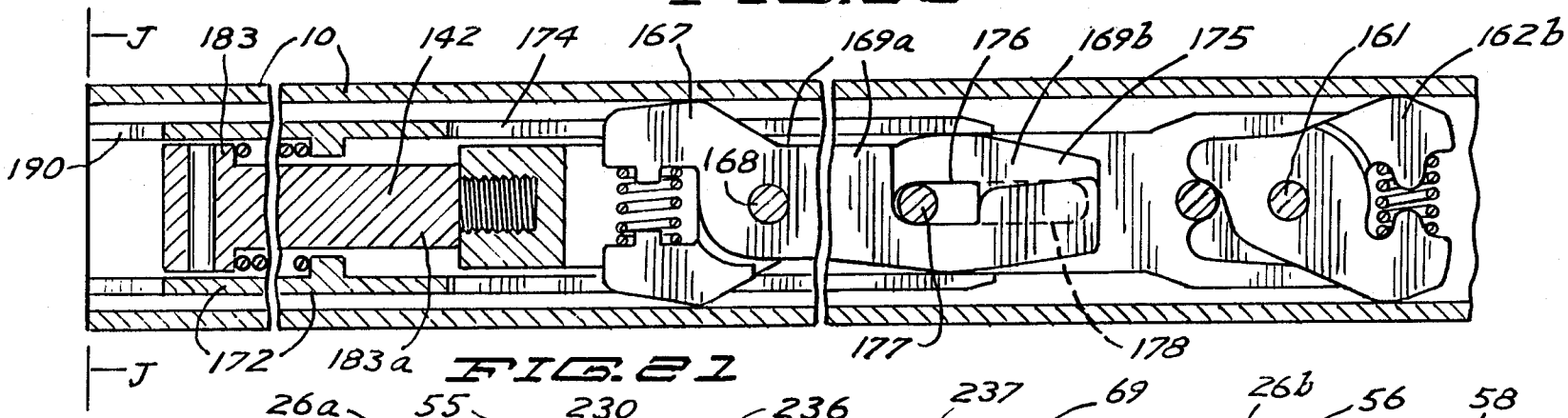
Figure 22:
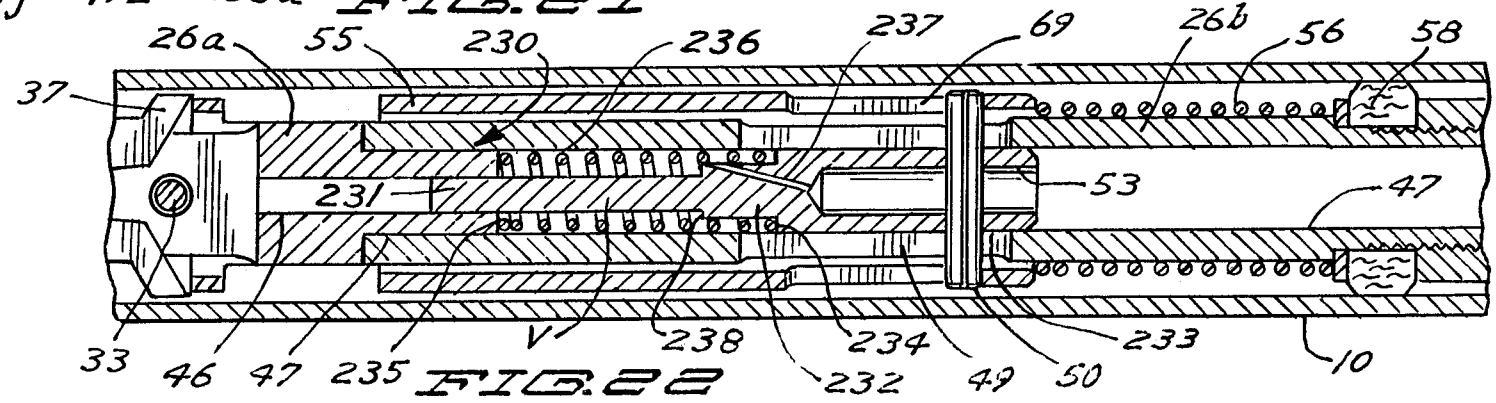
FIG. 22 is a fragmentary sectional view of the third embodiment with the valving mechanism in the pump-in position.

In using the first embodiment of the invention, the core barrel inner tube assembly is inserted into the outer end of the drill string (see FIG. 7). Edge portions of the latch intermediate portions 39 are prevented from abutting against the drill string inner peripherial wall due to the latch feet abutting against the beveled outer terminal transverse edge of the main body portion 55*a*, the latch feet extending further radially apart than the inner diameter of the tubuler member main body portion 55*a* to abut against the outer transverse edges thereof which extend arcuately between legs 55*b*. The outer transverse edges of the main body are resiliently retained in abutting relationship with the feet by coil spring 56 to limit the axial outward movement of the tubular member relative to the latch body and also to prevent the latches moving to their latch seated positions until the tubular member is moved inwardly out of engagement with the latch feet.

If the valving mechanism is located such that it is in a fluid channel fully open position with the pin abutting against the outer ends of slots 49, upon pumping fluid under pressure into the drill string, pressurized fluid enters through the latch body slot 27 and acts against the outer end of the valve portion 51*a* and fluid flowing through the clearance space 61 and slots 49 to act against the inner terminal end of valve portion 51*b* and through passage 52, 53 to act against the annular surface at the juncture of valve portions 51*a*, 51*b* provides a pressure differential to move the valve member 51 inwardly to block the bypass channel 49, 54, 47, 68, 69, or if the drilling direction is downwardly can move under gravity to block the bypass channel. The inward movement of the valving mechanism is limited by the pin 50 abutting against the inner ends of slots 60.

Even upon the inner tube assembly moving inwardly to have the landing shoulder 64 seating on the landing ring, the latches are prevented from moving to their latch seated position due to the angles of inclination of the abuttable edges of the latches and the tubular member main body. Thus if the assembly is pumped inwardly a high pressure signal is provided at the drilling rig surface when the assembly seats on the landing ring or becomes jammed in the drill string. Similarly if the assembly is allowed to free fall under gravity to the bit end of the drill string, the valving mechanism moves outwardly relative to the latch body to open the bypass channel and upon the stopping of the inward movement of the assembly the valving mechanism closes to block the fluid bypass channel, and after sufficient time has elapsed for the assembly to seat on the landing ring, fluid is pumped in and a high pressure signal is provided at the surface.

After the assembly 15 has seated on the landing ring either upon the combination of pumping in fluid under pressure and gravity fall or initial pumping in, and with pin 50 abutting against the inner end of the tubular member slots 60, the pressurized fluid acting on the valving mechanism moves the tubular member inwardly against the action of spring 56 until pin 50 abuts against the inner end of slots 49. Now the main body 55*a* is moved out of engagement with the latch feet and the latches are resiliently pivoted to their latch seated position in the latch recess. In the latch seated position the maximum spacing of the latch feet is less than the inner diameter of the tubular member. Further if only one of the latches does not move to be abuttable against the inner terminal edge of the latch coupling 20 and the other one does, the tubular member is precluded from moving axial outwardly of a position that the tubular member main body terminal edges extending between the legs 55*a* abuts against the nonfully extended latch; and accordingly the bypass channel remains closed.

In order to open the bypass channel the operator has to stop the pump unit, or least take action to decrease the pump-im pressure sufficiently that the spring 56 can move the tubular member 55 outwardly and thereby pin 50 outwardly to move the valving mechanism outwardly to open the bypass channel. The outward movement of the tubular member is limited by one o both of the main body edges that extend between the legs 55*b* abutting against the inwardly facing shoulders 29*a* formed at the juncture of the latch body plate portion 29 with portions 28 or the pin 50 abutting against the outer ends of the latch body slots 49. At this time the bypass channel is considered to be in its fully open condition.

Also if the inner tube assembly free falls to its landing position, after the valve member falls to block the bypass channel and if both of the outer latches do not move to their latch seated position, at least one of the latch feet abuts against the outer edge of the main body of the tubular member to prevent the tubular member moving outwardly to in turn move the pin 50 whereby the fluid bypass channel is at least partially opened. Thus in the event the inner tube assembly stops in the drill string above its landing ring stopping position, the channel to bypass the landing ring does not open and accordingly a positive high pressure signal is obtained to indicate the inner tube assembly is not in condition for taking core after the pumping in of fluid is stopped and then restarted.

When the inner tube is filled with core the shut off member 71*b* is squeezed to expand radially to provide a high pressure signal at the surface as is conventional, member 71*b* being a part of the spindle assembly 71. The overshot assembly 44 or another appropriate overshot assembly is inserted into the drill string and pumped inwardly. As the overshot assembly is pumped inward the spring 94 retains the coupling tube 98 relative to the overshot body to block ports 86 and in conjunction with valve member 87 prevents any significant inward fluid flow past the overshot assembly. Of course if the drilling direction is downwardly, a non-fluidly propellable overshot assembly having an inner end such as shown in FIG. 6 can be used.

Due to the inner diameter of the tubular member legs 55*b* being greater than the maximum diameter of the overshot bore portion 96*a* and less than the outer diameter of the coupling member, as the flange 98 passes inwardly of latch body head part 30*a*, the flange abuts against the legs to move the tubular member 55 inwardly relative to the latch body and against the resilient force of spring 56 sufficiently the latch feet are movable into the slots 62. Thereafter the flange abuts against the beveled surface 44*a* of the latches to move the latches from their latch seated position. Upon the flange moving inwardly of latch portions 35, the outer ends of the latches are spring urged away from one another such that shoulders 43 are at least in part directly axially outwardly of annular shoulder 100 of the flange. The inward movement of the overshot assembly is limited by the flange 98*a* abutting against the outer, generally transverse edges of latch parts 39. While the tubular member is moved inwardly and the latch portions are moved toward one another, the latch feet 37 move into slots 62.

Now upon retracting the overshot assembly the overshot body is moved relative to the coupling tube to open the overshot bypass channel. Thence the coupling tube is retracted, the latch body being retracted therewith. The feet in extending into slots 62 prevent the tubular member moving inwardly relative to the latch sufficiently to permit the valving mechanism moving to fully block the bypass channel of the inner tube assembly.

Referring to FIGS. 13–19, the second embodiment of the invention inwardly of FIG. 16 is of substantially the same construction as that inwardly of the spindle assembly 71 of the first embodiment. The drill string may be the same as that of the first embodiment other than the location of the latch recess 141 and the length thereof The second embodiment includes a core barrel inner tube assembly, generally designated 140, having an axially elongated latch body 142 that at its inner end portion has the intermediate diamter, outer end portion 143*a* of the spindle 143 threadedly extended into the central bore 144 of the body 142 (see FIG. 15). A lock nut 145 on portion 143*a* abuts against the latch body.

Inwardly of the lock nut, portion 143*a* is joined to the axial intermediate portion 143*b* of the spindle to form an outwardly facing annular transverse shoulder to have the resilient seal member 147 abut thereagainst and substantially form a fluid seal with the radial adjacent port of the radial inner peripheral wall portion of the drill string (except when radially adjacent to the latch recess). A nut 148 is threaded on portion 143*a* for adjustably varying the compression of seal member 147. The inner ports 149 are provided in spindle portion 143*b* to open to the clearance space between the drill string and the spindle inwardly of the seal member 147. Ports 149 open to the central bore 150 which at its outer end opens to the annular shut off valve 153 in the latch body bore 142*a*. A spring 154 abuts against the outer closed end of bore 142 and valve 152 to resiliently retain the valve in abutting relationship to the spindle. Ports 156 open to the interior of the drill string outwardly of the seal member 147. The valve 153 includes an inner orifice 153*b* and is of a construction that in conjunction with the outer end of the spindle provide a fully open bypass channel 149, 150, 142*a*, 156 when fluid flow is inwardly but will move outwardly under outward fluid pressure to block ports 156 to prevent an outward flow rate sufficiently great to move the spearpoint subassembly R to its latch retracting position. The subassembly R will be described hereinafter. The reduced diameter portion 143*c* of the spindle extends inwardly of spindle portion 143*b* and mounts the shut-off valve assembly 158 which is conventional.

Outwardly of the ports 156 the latch body has an axially elongated slot 160 that extends radially therethrough. A transverse pin 161 is mounted by the latch body 142 to pivotally mount a pair of inner latches 162*a*, 162*b* in the inner end of slot 160. A spring 165 urges the latches to pivot in opposite directions to their latch seated position of FIG. 15, the movement of the latches in said opposite directions being limited by a stop pin 164 when not limited by the drill string. The inner latches in their latch seated position in the latch recess abut against the landing ring 166 in the latch recess to limit the inward movement of the inner tube assembly and are shaped to have beveled edges 162*c* for moving the latches to their retracted position by the drill string as the latches are moved outwardly of the latch recess.

Also pivotally mounted in the latch body slot 160 to be outwardly of the latches 162*a*, 162*b* by a transverse pin 168 which is mounted by the latch body are a pair of outer latches 169*a*, 169*b*. A coil spring 171 urges the latches 169*a*, 169*b* to their latch seated position wherein the latches block outward movement of the core barrel inner tube assembly. The outer, annular head portion 142*a* of the latch body is axially movably extended into an axially intermediate part of the latch release tube 172 which forms a part of the valve control mechanism The latch release tube has retract slots 174 through which the outer end portions 167 of the outer latches extend in moving to their latch seated position, the slots in part being defined by tube wall portions for abutting against the latches when the release tube is moved outwardly of the latch body to move the latches out of their latch seated position. The outer latches have inner end portions 175 that in their retracted position are transversely over lapped which in effect cooperatively provide a transverse opening 176 through which the transverse pin 177 of the valve control mechanism extends. The pin 177 also extends through an elongated slot 178 in the latch body and is mounted to the latch release tube in a fixed position relative to the release tube. The latch release tube has axially elongated slots 180 that open through the inner transverse edges to permit the latch portions 175 moving transversely to their transverese spread apart positions as the latches move to their latch seated position. When the outer latches have moved to their latch seated position the inner portions 175 of the latches have their generally axially extending, radially adjacent edges 175*a* transversely spaced by at least a minimum distance that is at least as great as the diameter of pin 177. As a result the latch release tube can move axially inwardly relative to the latch body from the position of FIG. 15 to that of FIG. 17 only when both of the outer latches have moved from their latch retracted position to their latch seated position. The movement of the release tube inwardly of the latch body is limited by the length of the slots 178.

The latch body further includes an axially elongated stop portion 183 that has a reduced diameter inner end threadly mounted by the latch body portion 142*a* that is located outwardly of the outer latches, an elongated axially intermediate, intermediate diameter portion 183*a* extended through a latch release tube, annular, interior flange 172*b* and an outer enlarged diameter portion 183*b* that has a transverse bore 185 extending therethrough. A coil spring 184 in portion 183*a* abuts against stop portion 183*b* and a flange 172*b* to resiliently urge the latch release tube to move relative to the latch body to permit the outer latches moving to their latch seated position. The relative diameters of the stop portion and the latch release tube are such to provide an annular clearance for fluid to flow into and out of the space between the latch release tube and portion 183*a* and axially between portion 183*b* and flange 172*b*.

For retracting the latch release tube and permitting the core barrel inner tube assembly being fluidly propelled axially upwardly, there is provided the spearhead (spearpoint) subassembly R that has an axially elongated cylinder tube 188 having an inner end that may be moved to abut against the portion 183*b* and have its cylinder bore 191 opening to portion 183*b*. A transverse pin 189 is mounted by the inner end portion of the cylinder tube in a fixed axial position relative thereto and extends into axially elongated slots 190 of the latch release tube, the slots being axially outwardly of flange 172*b* and even when the cylinder tube abuts against latch body portion 183*b*, for the most part, extends axially outwardly of portion 183*b*.

Located within the cylinder bore is an axially elongated piston 194 of the valving mechanism 194, 215 which has a lower end portion 194*a* of a diameter to at least substantially form a fluid seal with the radially adjacent part of the inner peripheral wall of the cylinder tube that defines the cylinder bore. The piston portion 194*a* mounts a transverse cam pin 195 of the valve control mechanism in a fixed position relative thereto and of a length that is greater than the inner diameter of the outer end portion of the latch release tube and extends into the diametric opposite cam slots, generally designated 196, in the intermediate part of the cylinder tube. Each of the cam slots includes an axial leg 197, the inner end of which is closed and the outer end of which opens to the inner end of the inclined leg 198 that extends circumferentially and outwardly relative to leg 197. The outer end of the leg 198 opens to the outer end of the inclined leg 199 that is oppositely inclined from the direction of inclination of leg 198, and has its inner end about midway between the inner and outer ends of the inclined leg 198 and extend away from leg 198 in the same circumferential direction that leg 198 extend away from leg 197. A pump-in leg 200 has its inner end opening to leg 197 axially intermediate the inner and outer ends of slot leg 197 and is inclined outwardly and circumferentially away from slot leg 197 in an angular direction opposite that of leg 198 The slot legs are of transverse dimensions that pin 195 can move from the outer end of leg 200 (FIGS. 13, 18) to the inner end of leg 197 (FIG. 19) and thence to the inner end of leg 199.

The outer end portion of the the latch release tube has a pair of diametric slots 201 that open through the outer transverse edge of the latch release tube. Slots 201 are generally axially aligned with slot legs 200 and are maintained in axial alignment therewith due to the pin 189 being of a diameter only slightly smaller than the circumferential dimension of slots 190. When the pin 177 is being retained in its axial outer position by the outer latch portions 175 being in their retracted position and if the pin 195 has been previously moved to the FIG. 18 position, the cam pin 195 abuts against axial edges defining slots 201 to prevent the cam pin moving into slot legs 197. A transverse pin 204 is mounted by the cylinder tube to be in a fixed position relative thereto outwardly of the pin 189 and cam slots 196. A coil spring 205 is provided in the cylinder tube bore for abutting against pin 204 and the piston inner end to constantly urge the piston to move outwardly.

The piston has an inner and outer guide portion 194*a*, 194*c* with a reduced diameter portion 194*b* that is joined to and extends between portions 194*a*, 194*c*. Portion 194*b* is of an axial length that when pin 195 abuts against the inner end of slots 196, fluid can flow through slots 196 into the cylinder bore, but not through the bore to either axially outwardly of piston portion 194*c* or axially inwardly of piston portion 194*a*.

A short distance inwardly of the outer terminal end of the cylinder tube the cylinder bore has a bore portion 191*a* that is of a a substantially greater diameter than the diameter of the constant diameter bore portions 191*b*, 191*c* that respectively extends axially outwardly and inwardly of bore portion 191*a*.

The spearpoint subassembly R also includes a spearpoint plug 207 that has an axially extending bore 208 that is closed at its outer end and at its inner end portion is threaded on the outer end of the cylinder tube Inwardly of the plug an adjustment nut 209 is threaded on the cylinder tube to abut against the resilient annular fluid seal member 210 which in turn abuts against the enlarged diametric flange 188*a* of the cylinder tube. The nut threaded to compress the seal member to substantially form a fluid seal with the drill string outwardly of the latch seat. The plug and adjustment nut 209 are of diameters to provide an annular clearance space with the drill string outwardly of the seal member member 210.

Outwardly of the cylinder tube the spearpoint plug has transverse outer ports 211 that open to the clearance space surrounding the spearpoint 207 inwardly of the closed end of the spearpoint bore 208. Within the bore 208 there is provided a coil spring 214 which abuts against the closed end of the bore and against the a spherical valve ball 215 of the valving mechanism to resiliently retain the ball in abutting relationship to the piston stud portion 194*d*. The ball is of a diameter that it can be completely located in the bore 208 outwardly of the outermost part of the opening of ports 211 to bore 208, to substantially form a fluid seal with the walls defining bore portions 191*b*, 191*c*, and when its center of curvature is located within bore portion 191*a*, to permit limited fluid bypass within the cylinder bore 191. Advantageously the axial length of bore portion 191*a* is at least about a $\frac{1}{3}$ of the diameter of the ball.

Just inwardly of the shoulder 188*a*, the cylinder tube has ports 217 for placing the cylinder bore in fluid communication with the clearance space between the cylinder tube and drill string that is inwardly of the seal member 210. Ports 217 are sufficiently axially outwardly of the cam slots that piston portion 194*c* can never completely block these ports, even when cam pin 195 is located in the outermost part of the slots 196. Even when the cam pin is located in their innermost ends of slots 196, piston portion 194*c* located to substantially block axial fluid flow within the cylinder bore between ports 217 and slots 196. The ports 211, 217 and bore 191 form an axial outer bypass channel.

The structure of the second embodiment of the invention having been described, the use thereof will now be set forth. When the inner tube assembly is outside of the drill string and the outer latches are in their extended (latch seated) position, a suitable tool, for example a rod with a hole in one end to have the pin to extend thereinto, is forced inwardly and circumferentially into slot legs 200, provided the pin is not located in leg 200. The piston is then retained in such a position by spring 205 which exerts a spring force greater than that of spring 208. At this time the piston and spring 214 act to retain the valve ball outwardly of bore portion 191*a* to block fluid flow axially inwardly of the ball and thus the fluid bypass channel 211, 191, 217 is blocked.

As the inner tube assembly is moved into the drill string the inner latches 162*a*, 162*b* are moved to their retracted position and thence the latch release tube is manually moved to its latch retract position against the action of the coil spring 184 to retract the outer latches. This moves the stop portion 183 against the cylinder tube and as the outer latches are moved into the drill string, the drill string retains the outer latches in their retracted position. With the outer latches in their retracted position the outer latches inner end portions prevent the transverse pin 177 and thereby the latch release tube moving inwardly relative to the latch body. Further the latch release tube in being moved to its latch retract position, the release tube slots 201 move axially sufficiently that the latch release tube prevents the cam pin moving out of the cam slot legs 200 due to the pin abutting against the tube wall portions that define the the outwardly opening slots 201. As a result the piston can not move out of the pump-in, outer fluid channel inward fluid flow blocking position shown in solid lines in FIG. 13.

When the piston is in its pump-in position the piston prevents the valve ball moving inwardly in the cylinder bore from inward fluid bypass blocking position while fluid seal member 210 prevents fluid bypass in the drill string exterior of the bypass channel 217, 211, 191.

In the event the core barrel inner tube assembly is allowed to move under gravity toward the bit end of the drill string (or moves downwardly faster than the column of fluid in the drill string) the outward fluid pressure inwardly of the spearpoint assembly fluid seal member 210 results in the valve ball moving outwardly of bore 191 against the action of spring 208 to a position opening the bypass channel 211, 191, 217 (dotted line position of FIG. 13). However normally the pressure is not so great to cause shut off valve 153 moving to block the inner fluid bypass channel. Of course if there is sufficient outward pressure to maintain valve 153 closed, than the inner tube assembly has to be pumped in.

When the core barrel inner tube assembly has moved inwardly to a position the inner latches 162*a*, 162*b* are radially adjacent to the drill string latch seat, the inner latches move to their latch seated position and upon abutting against the landing ring a high pressure signal is provided at the drilling surface. When in the last mentioned position, the outer latches are free to and are resiliently moved to their latch seat position, it being noted that when the pin 171 abuts against inner end portion 175 of the latches the inner wall portions that in part defining the slots 174 are located to permit the outer latches so moving. When both of the outer latches are in their latch seated position, the blocking pin 177 is free to move axially inwardly relative to the latch body between edges 175*a* and as a result of the action of spring 184 the release tube does move inwardly relative to the latch body. The inward movement of the latch release tube permits the cam pin 195 to move inwardly into the inner end of cam legs 197 and if the assembly is pumped in the fluid pressure on the valving mechanism is valving to move the piston and thereby the pin inwardly into the inner end of the legs 197, the ball 215 moves into bore portion 191*a* and allows a low rate of fluid bypass which will reduce the pressure at the surface. However the pressure signal does not reduce anywhere near the reduction that would take place if the fluid channel were fully open. In the event the inner tube assembly is allowed to free fall to the bit end of the bore hole, pin 195 does not move to the inner end of the cam slots until fluid is pumped into the drill string.

The pin remains in the inner end of the slot legs 197 as long as the pump-in pressure is maintained. Once the cam pin is in the inner end of the cam slots the pump-in of pressurized fluid has to be stopped, or the pump-in pressure has to be reduced substantially to allow the spring force to be greater than the force acting to move the piston inwardly, which requires a positive action by the operator. Once the pump-in pressure is sufficiently reduced the piston is resiliently moved outwardly so that the cam pin moves into the outer ends of the slot legs and the valve ball is forced into bore 208 to be located outwardly of ports 211. Thereafter the pumping is restarted and the piston is move inwardly, however the intersection of legs 198, 199 is such that the piston in moving inwardly moves to the inner end of legs 199 to prevent further inward movement of the piston relative to the cylinder tube. When the cam pin is at the inner ends of the legs 199, the piston still retains the valve ball completely outwardly of the ports 211 so that outer bypass channel remains fully open.

In the event the column of water above the piston is too heavy to permit the spring 205 moving the piston outwardly and thereby the cam pin being moved outwardly from the inner ends of slot legs 197, liquid will drain between the ball valve and the inner peripheral wall portion defining bore portion 191*a*. Upon a sufficient lowering of the column of water in the drill string the valve ball is moved outwardly of the opening of ports 211 to the spearpoint bore 208.

In the event the second embodiment should become jammed in the drill string outwardly of its core collecting position, or if one or both of the outer latches does not pivot sufficiently to abut against the inwardly facing shoulder that in part defines the latch seat, the latch release tube is prevented from moving inwardly relative to the latch body by the pin 177 abutting against the inner end portions 175 of the outer latches and accordingly the outer bypass channel remains blocked for inward fluid flow and a high pressure signal is provided at the drilling surface.

After the core receiving tube is filled and the shut-off valve 158 is compressed to provide a pressure signal at the surface, a conventional wire line overshot assembly is pump-in or allowed to free fall, depending on the drilling direction and the drilling conditions. Upon the overshot assembly coupling onto spearpoint plug portion 207*a*, the initial retraction of the spearpoint plug through the cylinder tube retracts pin 189 to abut against the outer edges of the slots 190. Further retraction moves the latch release tube and thereby pin 177 to be axially inwardly of the outer latch portions 175. Thereupon the inner beveled edges that in part define slots 174 abut against the beveled edges of the outer portions of the outer latches to pivot the outer latches to their retracted position. After the outer latches have been retracted and pin 177 abuts against the outer ends of the latch body slots 178, further retraction of the overshot assembly results in pin 177 moving the latch body outwardly, and upon the outer diagonal edges 162*c* abutting against the axial outer edge of the latch seat, the latches 162*a*, 162*b* are pivoted to their retracted position. The outward movement of the latch body retracts the structure attached thereto and extending inwardly thereof.

During the time the overshot assembly moves toward the spearpoint subassembly and as it retracts the spearpoint subassembly the valve ball remains in the dotted line position of FIG. 13 so that the bypass channel remains open.

Even though the above two embodiments of the invention have been described with reference to a core receiving tube, core lifter and core lifter case, it is to be understood that in place thereof there may be provided on the inner end of the core barrel inner tube assembly, another type of tool, for example a plug bit or other type of drill bit in the event it was not desired to collect a core sample.

With reference to the second embodiment the inner latches can be eliminated by substituting for ring 166, a landing ring having a smaller inner diameter and modifying the latch body to, inwardly of the outer latches have an annular, downwardly facing landing shoulder to seat on the modified landing ring and a bypass channel opening both inwardly and outwardly of the modified landing ring when the landing shoulder seats on the landing ring.

Referring to FIG. 22, the third embodiment of the invention, generally designated 230, is the same as the first embodiment except for the valving mechanism. Accordingly, other than for the valving mechanism, the same reference numbers will be used as used for the first embodiment. The valving mechanism V comprises a piston 231–233 having an outer stem portion 231 of a diameter to form a close sliding fit with bore portion 46 and a length about the same as that of portion 51*a*, and an axial inner portion 233 of a diameter to form a close sliding fit with bore portion 47 and mounts pin 50 of the valve control mechanism. The valve portion 233 is of a length to extend inwardly of the slot ports 60 and ports 54 to block inward fluid bypass when the latch release tube 55 abuts against the latches 16*a*, 16*b* in their latch seated position and pin 50 abuts against the inner ends of slots 60.

The piston also includes an axial intermediate part 232 that is of a diameter intermediate the diameters of parts 231, 233 and has its inner end joined to portion 233 to form an annular outwardly facing shoulder 234 and at its outer end at its juncture with the stem portion 231 form an annular outwardly facing shoulder 238 that is abuttable against or movable closely adjacent to the inwardly facing shoulder at the juncture of bore portions 46, 47, depending upon the length of outward extension of slots 49. A coil spring 236 is provided in bore portion 47 in surrounding relationship to the stem portion and has one end bearing against shoulder 238 and an opposite end against shoulder 235 formed by the juncture of bore portions 46, 47 to constantly urge the piston inwardly.

The piston also includes the leakage passage 53, 237 with passage portion 53 opening to bore portion 47 inwardly of the piston and to the much smaller diameter passage portion 237 The passage portion 237 opens to bore portion 46 closely adjacent to the shoulder formed by the piston shoulder 238.

The piston spring 236 gives a force great enough to move the the piston inwardly to its fluid channel blocking position regardless of the pump-in pressure or pump-in flow rares and the drilling direction except for one of the conditions as follows:

1. The latch release case (tublular member) 55 is outwardly of the limited position shown in FIG. 22, wherein the case abuts against the latch feet in their latch retracted position.

2. There is fluid pressure action acting on the surfaces of the piston facing axially inwardly that is greater than the pressure acting on the surfaces of the piston facing inwardly.

With reference to exception 2, and also to the first embodiment if the fluid seal member 58 is of a size to form little frictional contact or is radially adjustable in diameter by varying the axial threaded positions of nuts to the appropriate axial position), the inner tube assembly can be dropped in the drill string and fall through the moving or unmoving column of water in the drill string. The piston will moves outwardly relative to the latch body to allow the inner tube assembly to descend faster than if the were blocking the fluid bypass channel.

If for some reason the piston of the first embodiment would not move under fluid pressure to its channel blocking position, for example because of insufficient pump-in pressure or pump-in flow rates, other than the inner tube assembly is moving inwardly faster than the column of fluid in the drill string, the third embodiment may be used.

With both embodiments the valve control mechanism (50, 55, 56 and 172, 177, 195, 205 respectively) has to move relative to the latches from the position it was in during the time the inner tube assembly moves inwardly to the inner end of the bit hole after the inner tube assembly has moved to its latch seated position, before the valving mechanism is moved to its fluid channel inward fluid flow fully open position. Further the application of fluid under pressure has to be continued until after the valve control mechanism tubular memember has been moved inwardly relative to the latch body from the relative position that it was in prior to the inner tube assembly moving to the bit end of the drill string, or if the said assembly has free fallen to the bit end of the drill string fluid pump-in has been started; in either event, the pumping in has to be stopped or the pump-in pressure substantially reduced before the valving mechanism is moved to the fluid channel fully open position. The amount of reduction required would depend upon the spring force of the relevant ones of springs 56, 214, 205, 256. Additionally both of the latches that prevented outward movement of the inner tube assembly have to be in their latch seated position before the valving mechanism moves to the fluid channel fully open position after the said assembly is at the bit end of the drill string. Thus with this invention a high pressure signal is provided and maintained after the inner tube assembly is at the drill string bit end until the operator takes a positive step to reduce the pump-in pressure and then operates the pump controls (not shown) to increase the inward flow rate or restart the pumping of fluid if it had been completely stop to decrease the inward fluid flow.

What is claimed is:

1. A core barrel inner tube assembly propellable axially inwardly through a drill string to a latch seating position, comprising an axially elongated latch body portion, a latch mounted on the latch body portion for movement between a latch seated position and a latch retracted position, an annular fluid seal member for substantially forming a fluid seal with the drill string, axially elongated first means extending axially away from the latch body portion for defining a fluid bypass channel axially spaced from the latch that includes a bore portion, a first port and a second port, the seal member being joined to the first means axially between the ports in surrounding relationship to the bore, the first port opening to the bore portion and exterior of the first means outwardly of the seal member and the second port opening to the bore portion and exterior of the first means inwardly of the seal member, valving mechanism mounted for axial movement relative to the latch body portion between a first position extending at least in part within the bypass channel to block fluid flow inwardly through the bypass channel to permit the assembly being propelled inwardly by pressurized fluid, a second position axially inwardly of the valving mechanism first position for at least partially blocking the inward pressurized fluid flow through the bypass channel and a third position fully opening the fluid bypass channel, axially elongated valve control second means moveable relative to the latch body portion, the valving mechanism and the first means between a first position for blocking axial movement of the valving mechanism from the valving mechanism first position to the valving mechanism third position while the latch is in its retraced position and the assembly is being propelled inwardly by pressurized fluid and a second position that the valving mechanism is movable under inward fluid pressure from the valving mechanism first position to the valving mechanism second position, third means resiliently acting against at least one of the valving mechanism and the second means to move the valving mechanism has moved from its first to its second position and only after the pressure of inwardly propelling fluid has been substantially decreased, the third means acting against at least one of the latch body portion and the first means for resiliently urging the second means into abutting relationship with the latch in the latch retracted position while the assembly is being propelled inwardly by pressurized fluid to retain the second means in its first position and a drilling tool connected to one of the first means and the latch portion to extend axially inwardly thereof.

2. The apparatus of claim 1 further characterized in that the second means includes a transverse pin extended through the valving mechanism and a tubular member having an axially elongated slot with the transverse pin extended thereinto.

3. The apparatus of claim 1 further characterized in that the valving mechanism includes an axially elongated piston extending within said bore portion, that the first means includes wall means defining an axially elongated slot having an inner end and an outer end, and that the second means includes a transverse pin mounted by the piston and extended into said slot for limiting the axial movement of the piston relative to the first means.

4. The apparatus of claim 3 further characterized in that the pin in the valving mechanism first position is axially spaced from both of the slot ends, in the valve mechanism second position abuts against the slot inner end and in the valving mechanism third position more closely adjacent to the slot outer end than when the pin is in the valving mechanism first position.

5. The apparatus of claim 3 further characterized in that the valving mechanism includes a valve ball moveable relative to the piston to block pressurized fluid axial inward flow through the bypass channel when the valving mechanism is its first position and that the piston maintains the ball outwardly of the opening of the first port to the bore portion when the valving mechanism is in its third position.

6. The apparatus of claim 3 further characterized in that the slot has a first axially elongated leg having an inner end and an outer end and a second leg that has an outer end angularly spaced from the first leg and axially intermediate the first leg inner and outer ends and opening to the first leg inwardly of the second leg outer end, the pin in the valving mechanism first position abutting against the second leg outer end, in the valving mechanism second position abutting against the first leg inner end and in the valving mechanism third position being located axially outwardly of the second leg outer end.

7. The apparatus of claim 6 further characterized in that the second means includes a latch retracting tube having an outer end portion that in the second means first position retains the above pin in the second leg and an inner end portion, and a second transverse pin mounted by the retracting tube inner end portion to abut against the latch in the latch retracted position when the second means is in its first position to retain the retracting tube in the second means first position, the latch body portion having an axially elongated slot that has an outer end portion and an inner portion and the second pin extended therethrough to limit the movement of the latch body relative to the retracting tube, the retracting tube in the second means second position permitting the first pin moving to the first leg inner end.

8. The apparatus of claim 7 further characterized in that the retracting tube has an axially elongated slot and that the first means includes a third transverse pin extended into the retracting tube slot whereby the movement of the retracting tube relative to the first means is limited, and that the third means includes first spring means acting between the latch body portion and the retracting tube to constantly urge the second means from its first position to its second position and second spring means acting between the first means and the piston to constantly urge the piston to the valving means third position.

9. The apparatus of claim 3 further characterized in that the second means comprises a tubular member with the first means extended thereinto and having the elongated slot into which the transverse pin extends in axial movable relationship thereto.

10. The apparatus of claim 9 further characterized in that the third means comprises a spring acting between the first means and the the tubular member to resiliently urge the tubular member into abutting relationship to the latch in the latch retracted position and have the transverse pin abut against the tubular member slot inner end and axially intermediate the first means slot ends when the assembly is being fluidly propelled inwardly, that in the valve mechanism second position, the pin abuts against the inner ends of both the tubular member and first means slots and in the valve mechanism third position is at least more closely adjacent to the first means slot outer end than the first means slot inner end.

11. The apparatus of claim 10 further characterized in that the first means slot opens to the bore portion to form part of the fluid bypass channel and that the piston includes an axial portion of a length and a diameter to block fluid flow through the first the first means slot into the bore portion when the valve mechanism is in each of its first and second positions.

12. A wire line core barrel inner tube assembly moveable through a drill string to the inner end of a bore hole and having a central axial extending axis, comprising an axially elongated latch body, a latch mounted by said body for movement betwen a latch release position and a latch seated position, said latch body having a fluid bypass channel that includes an axially extending bore, an outer port opening exterior of the latch body and to the bore, and an inner port opening exterior of the latch body and to the bore axially inwardly of the opening of the outer port to the bore, annular fluid seal means on the latch body axially between the opening of the ports exterior of the latch body for substantially forming a fluid seal with a drill string, valving mechanism extending within the bore and mounted for limited movement in the bypass channel between a first position blocking fluid flow through the bypass channel and a second position permitting fluid flow through the channel to bypass the fluid seal means, a tubular member having the latch body extended into and axially moveable a limited amount relative to each of the valving mechanism and the latch body and moveable in one axial direction to abut against the latch in its release position to limit the movement of the tubular member in said one direction relative to the latch body to a first limit position as the latch body moves toward the inner end of the bore hole and being further moveable in said one direction when the latch is in its latch seated position, resilient means acting against the latch body and the tubular member in said one direction, including past the said first limit position when the latch is in its seated position, the valving mechanism and tubular member having cooperating means that in conjunction with the latch body limit axial movement of the tubular member and the valving mechanism relative to the latch body in the opposite axial direction wherein the valve mechanism blocks the bypass channel, and to permit the valving mechanism to move relative to the tubular member and latch body to unblock said channel to allow axial outward flow in said bore when the tubular member is retained in its first limit position, and to move the valve mechanism to open said fluid channel when the spring means moves the tubular member in said one axial direction past said limit position and the latch is in its seated position.

13. The apparatus of claim 12 further characterized in that the tubular member cooperating means includes a tubular member wall portion defining an axially elongated slot having an inner end and an outer end, that the valving mechanism cooperating means includes a piston mounted in the bore and a transverse pin mounted by the piston for moving therewith and extended into said slot, the piston blocking the fluid channel when the pin abuts against the slot inner end with the tubular member in the first limit position and that when the tubular member is moving in said one axial direction past said first limit position with the piston in its channel blocking position, moving the pin and thereby the piston in the bore to unblock the channel.

14. The apparatus of claim 13 further characterized in that the latch body inner port is defined by a latch body wall portion in the form of an axially elongated second slot that has an inner end and an outer end, the transverse pin extending into the second slot and when adjacent to the second slot inner end, the piston is in its channel blocking position and when the pin is adjacent the second slot outer end, the piston is located in the bore such that the fluid channel is at least nearly fully open.

15. The apparatus of claim 12 further characterized in that the latch body includes a radial central axial outer head, an axially elongated slot opening transversely outwardly and extending inwardly of the head, and that the latch includes a latch member having an axial outer portion, an axial intermediate portion and an axial outer portion, an axial intermediate portion and an axial inner portion, the latch axial outer, axial intermediate and axial inner portions each having a transverse inner, axial extending edge, and a pivot member pivotally mounting the latch member to the latch body, the latch member outer portion having a beveled first edge that extends inwardly and transversely outwardly, and a general axial second edge that when the latch is in its latch seated position, is located more closely adjacent to the central axis than either of the maximum transverse spacing of the first edge and the intermediate portion from the central axis, the first edge when the latch is in its latch seated position extending transversely more remote from the central axis than the head, and that the latch member inner end portion includes an axial outer part having an transverse outer axial edge and a foot part inwardly of the outer part that when the latch is in its latch retracted position, extends in the same transverse direction away from the central axis and more remote from the central axis than the outer part, the tubular member in its first limit position abutting against the foot part.

16. The apparatus of claim 15 further characterized in that the tubular member is moveable in said one direction to a second limit position axially outwardly of the first limit position, and has a first edge portion abuttable against the foot part in the first limit positiond and an outer terminal edge portion located axially outwardly of the first edge portion, the second edge portion being located outwardly of the latch and transversely outwardly of the head when the latch is in its latch seated position and the tubular member is in its second limit position.

17. A wire line core barrel inner tube assembly moveable through a drill string to the inner end of a bore hole and having a central axial extending axis, comprising an axially elongated overshot coupling subassembly that has a fluid bypass channel and an annular fluid seal portion for substantially forming a fluid seal with a drill string as the assembly moves to a position at the inner end of a bore hole, the fluid channel including an axially elongated bore extending through the fluid seal portion, an outer port opening to the bore and exterior of the subassembly outwardly of the fluid seal portion and an inner port opening to the bore and transversely outwardly exterior of the assembly inwardly of the fluid seal portion, valving mechanism extending within the fluid channel and mounted for movement between a first position blocking inward fluid flow through the channel, a second position inwardly of the first position that at most permits only limited inward fluid flow through the channel and a third position fully opening the fluid channel, the valving mechanism being mounted by the coupling subassembly for movement from the valving mechanism first position to its third position only after the exertion of inwardly fluid pressure on the valving mechanism to move the valving mechanism towards its second position and than decreasing said fluid pressure being exerted to full open said channel, first means in said bore for constantly resilient biasing the valving mechanism to its second position, a latch body extending inwardly of the coupling subassembly, a latch mounted by the latch body for movement between a latch release position and a latch seated position, means for resiliently urging the latch to its latch seated position and second means mounting the latch body to the coupling subassembly and moveable relative to the latch body between a first position retaining the valving mechanism in its first position until the latch is moved from its latch release position to the latch seated position and then moveable to a second position to permit the valving mechanism moving to the valving mechanism second position.

18. The apparatus of claim 17 further characterized in that the valving mechanism includes a piston, third means mounted by the piston for retaining the piston in the valving mechanism first position until the second means moves from its first position and a valve ball mounted in the bore for blocking the inward fluid flow through the channel while the piston is in the valving mechanism first position and moveable in the bore relative to the piston to permit outward flow through the channel.

19. The apparatus of claim 18 further characterized in that the first means abuts against the ball for resiliently retaining the ball in abutting relationship to the piston while exerting insufficient force to overcome the action of the first means.

20. The apparatus of claim 18 further characterized in that the third means is movable to the valving mechanism third position wherein the piston retains the ball in a fluid channel fully open position.

21. The apparatus of claim 18 further characterized in that the bore has wall portions defining first and second diameter bore portions of diameters substantially the same as the ball diameter and an axial intermediate bore portion of a diameter sufficiently larger than the first and second bore portions to permit axial inward bypass fluid flow when the ball is located in the intermediate bore portion at a rate substantilly less than that when the valving mechanism is in its first position, the ball being located in the first diameter bore portion, the first bore portion being located axially intermediate the intermediate bore portion and the opening of the outer port to the bore.

22. The apparatus of claim 18 further characterized in that the second means comprises a latch release tube having axial outer, first axially elongated slots and an axial inner, second axially elongated slot and an axial outer transverse pin mounted by the coupling assembly and extended into the first slots for limiting the movement of the release tube relative to the coupling subassembly, spring means acting between the latch body and the release tube to resiliently urge the release tube to move inwardly relative to the latch body, the latch body having an axially elongated slot, and a second transverse pin mounted by the release tube and extended into the latch body slot for limiting the axial movement of the release tube relative to the latch body, the latch being extendable through the release tube second slot and in the latch release position abutting against the second transverse pin for retaining the release tube in a position to abut against the third means and thereby retain the piston in the valving mechanism first position and prevent the release tube moving inwardly relative to the latch body.

23. The apparatus of claim 22 wherein said means for recovering core is attached to the latch body and that the latch body has a slot leg portion for recieving the third means and precluding the third means moving axially inwardly without first being moved outwardly once the piston has moved to the valving mechanism third position.

24. A wire line core barrel inner tube assembly moveable through a drill string to a position for recovering a core sample and having a central axis, comprising an axially elongated latch body having an outer end portion, an inner end portion and a latch slot, means attached to the latch body to extend inwardly thereof for recovering core, an axially elongated latch having an axial outer portion, an axial intermediate portion and an axial inner portion, each of the latch axial outer, intermediate and inner portion having a transverse inner, axial extending edge, and a pivot member extended through the latch intermediate portion for mounting the latch to the latch body for pivotal movement between a latch seat engaging position and a latch release position, the latch member having a beveled first edge that extends inwardly in a transverse outer direction and a transverse outer, generally axial second edge, that when the latch is in its latch seat engaging position, is located more closely adjacent to the central axis than either of the maximum transverse spacing of the said first edge and the intermediate portion from the central axis, and the intermediate portion having a latch seat engaging part, and the latch inner end portion having an axial outer part that has a transverse outer, axially extending edge and a terminal foot part inwardly of the latch inner portion axial outer part which in the latch seat position extends in the same transverse direction away from the central axis that the latch outer portion extends away from the central axis and more remote from the central axis than the latch inner portion outer part and in the latch release position extends in said direction transversely outwardly of the latch body and more remote from the central axis than the latch outer portion.

25. The apparatus of claim 24 wherein first means is provided on the latch body for forming a fluid seal with the drill string, the latch body having a bypass fluid channel that includes an outer port opening exterior of the latch body axially outwardly of the first means and an inner port opening exterior of the latch body axially inwardly of the first means, valving mechanism moveable relative to the latch body between a first position blocking inward fluid flow through the channel and a second position permitting inward bypass flow through the channel, second means mounted on the latch body for axial movement relative to the latch body between a first position in abutting relationship to the foot part in the latch retracted position permitting the valving mechanism being moved from the valving mechanism first position to valving mechanism second position and, when the latch is in its latch seat engaging position, and the valving mechanism second position, the second means in its first position being axially spaced relative to the latch body in one axial direction from the second means in the second means second position, and resilient means mounted by the latch body for constantly resilient urging the second means in said one axial direction to the second means second position.

26. A core barrel inner tube assembly fluidly propellable to the inner end of a bore hole regardless of the drilling direction and having a central axis, comprising an axially elongated latch body portion having an axially elongated latch slot, a latch extending within the latch slot and mounted to the latch body portion for movement between a latch seated position and a latch retracted position, first means extending axially relative to the latch body portion for forming a fluid seal with a drill string and defining a fluid bypass channel, valving mechanimm moveable relative to the first means between a first position blocking inward fluid flow through the channel and a second position fully opening the channel, and second means axially moveably in one axial direction from a first position for permitting the valving mechanism moving to allow axial outward flow through the channel while blocking axial inward fluid flow through the channel as the assembly moves toward the bore hole inner end, to a second position relative to the latch body portion to move the valving mechanism to the valving mechanism second position only after the latch has moved from its retracted position to its seated position and axial inward propelling fluid pressure is substantially decreased from that when the assembly is being propelled inwardly, the second means in its first position abutting against the latch in the latch retracted position to prevent the second means moving in said one direction.

27. The apparatus of claim 26 further charactized in that the first means includes wall means defining an outer bore portion having a first end opening to the latch slot and an inner second end, a second bore portion of a larger diameter than the first bore portion and having a first end opening to the first bore portion second end and a second end, and a port opening to the second bore portion and exterior of the first means, the bore portions and port forming at least part of the fluid bypass channel, and that the valving mechanism includes piston means mounted in said bore portions for movement under axial inward fluid pressure when the inward movement of the assembly is in an upward direction.

28. The apparatus of claim 26 further characterized in that the first means has wall means defining a bore that includes at least part of the fluid channel, the bore having an outer first bore portion opening to the latch slot and a second bore portion of a larger diameter than the first bore portion that opens to the first bore inwardly of first bore portion and that the valving mechanism is axially moveably extended in said bore portions and is moveable under fluid pressure to the valving mechanism first position from the valving mechanism second position even when the drilling direction is upwardly, the valving mechanism including a piston having an elongated first piston portion of a diameter to form a close slidable fit with the wall means defining the first bore portion, a second piston portion of a larger diameter than the first piston portion to form a close slidable fit with the wall means defining the second bore portion and a leakage pressure transmitting passage extending axially through the second piston portion to open to the first bore portion and to the bore inwardly of the piston whereby the piston may be moved solely under fluid pressure in an upward direction from the fluid channel open position to the fluid channel blocking position.

29. The apparatus of claim 26 further characterized in that the first means has wall means defining a bore that includes at least part of the fluid channel, the bore having an outer first bore portion opening to the latch slot and a second bore portion of a larger diameter than the first bore portion opening to the first bore portion and extending inwardly of the first bore portion, and that the valving mechanism includes a piston having an outer portion of a diameter to form a close sliding fit with the outer bore portion and an inner piston portion of a diameter to form a close sliding fit with the second bore portion, and that there is provide spring means in the second bore portion for resiliently urging the piston inwardly.

30. The apparatus of claim 26 further characterized in that the second means includes a tubular member having the first means extended thereinto and axially moveable in said direction from the second means first position abutting against the latch in the latch retracted position to limit the movement of the tubular member in said one direction and resilient means acting against at least one of the latch body portion and the first means for constantly urging the tubular member to move relative to the the latch body in said one direction to the second means second position.

31. The apparatus of claim 30 further characterized in that the tubular member includes a leg that in the tubular member second means second position extends outwardly of the latch, that the second means includes a transverse pin for moving the valve mechanism from the valve mechanism first position to the valve mechanism when the tubular member moves to the tubular member second means second position.

32. The apparatus of claim 30 further characterized in that the second means includes spring means acting against the first means for constantly urging the valve mechanism to the valve mechanism second position and a transverse member mounted by the tubular member to abut against the latch in its retracted position to prevent the tubular member moving to its second position.

33. The apparatus of claim 30 wherein the valving mechanism is moveable to a third position axially inward of both of its first and second positions, that the valving mechanism in its second position is axially outwardly of the valving mechanism first position, that the first means includes wall means defining a cam slot having an axial first leg that has an inner end and an outer end, and a second leg inclined relative to the first leg and having a first end opening to the first leg inwardly of the first leg outer end and an outer end circumferentially spaced from the first leg and axially intermediate the first leg ends and that the second means includes a cam pin mounted to the valving mechanism, and extended into the cam slot to be outwardly of the second leg when the valving mechanism is in its first position and against the second leg outer end when the valving mechanism is in its first position, the inward movement of the cam pin out of the second leg being blocked when the tubular member in said one direction is limited.

34. The apparatus of claim 33 further characterized in that said cam slot includes a third leg that is inclined and has an inner end opening to the first leg outer end and an outer end outwardly of the third leg inner end, and extending angularly from the first leg in a direction opposite the direction that the second leg extends away from the first leg, and a fourth leg that is inclined to extend away from the third leg in the same angular direction theat the third leg extends away from the first leg, the fourth leg having an outer end opening to the third leg outer end and an inner end axially intermediate the third leg ends, the cam pin in the valving mechanism second position being located in one of the third leg outer end and the fourth leg inner end.

* * * * *

UNITED STATES PATENT AND TRADEMARK OFFICE

CERTIFICATE OF CORRECTION

PATENT NO. : 4,834,198

DATED : May 30, 1989

INVENTOR(S) : Terrence L. Thompson

It is certified that error appears in the above-identified patent and that said Letters Patent is hereby corrected as shown below:

Column 2, line 58, change "or" to --(or--.
Column 3, line 41, change "12'12" to --12-12--.

Column 6, line 6, change "passage" to --Passage--.
Column 9, line 9, "o" to --or--.
Column 12, line 69, change "tube" to --tube.--.

Column 16, line 43, change "237," to --237.--; and line 61, change "or" to --(or--.

mechanism--
Column 19, line 39, change "slots" to --slots,--.

Column 21, line 34, "assembly" to --subassembly--.
Column 23, line 11, change "seat" to --seated--; and line 36, after "mechanism" insert --is in its first position, a second position to move the valving mechanism to the valving mechanism.--.

Signed and Sealed this

Ninth Day of June, 1992

*Attest:*

DOUGLAS B. COMER

*Attesting Officer*

*Acting Commissioner of Patents and Trademarks*